United States Patent [19]

Serkov et al.

[11] 3,972,209

[45] Aug. 3, 1976

[54] APPARATUS FOR WASHING YARN DURING MOVEMENT THEREOF

[76] Inventors: Arkady Trofimovich Serkov, prospekt Mira, 131, kv. 20, Moscow; Boris Matveevich Sokolovsky, ulitsa Pervomaiskaya, 27, kv. 71, Mytischi Moskovskoi oblasti; Viktor Alexandrovich Kalitin, ulitsa Dispansera, 38, korpus 1, kv. 75, Mytischi Moskovskoi oblasti; Nina Petrovna Shishkina, ulitsa Scherbakova, 4, kv. 41, Mytischi Moskovskoi oblasti, all of U.S.S.R.

[22] Filed: Nov. 18, 1974

[21] Appl. No.: 524,743

[52] U.S. Cl. ..... 68/22 R; 68/203; 118/246

[51] Int. Cl.[2] ..... D06B 1/14

[58] Field of Search ..... 68/22 R, 202, 203; 118/244, 246, 248, 249

[56] References Cited

UNITED STATES PATENTS

| | | | |
|---|---|---|---|
| 660,029 | 10/1900 | Remy | 68/22 R |
| 2,342,266 | 2/1944 | Gessner | 68/22 R |
| 3,174,312 | 3/1965 | Barker | 68/202 X |

*Primary Examiner*—Philip R. Coe
*Attorney, Agent, or Firm*—Steinberg and Blake

[57] ABSTRACT

An apparatus for washing freshly spun artificial yarn during its movement relates to the finishing of yarn such as viscose yarn. By this apparatus, yarn is intermittently saturated with a finishing solution on that portion of a rotating roll which extends outside the finishing solution contained in a tank. Between the saturation zones, the yarn is spaced apart from the roll surface for diffusion and squeezing of yarn. In order to ensure the intermittent saturation of yarn with the finishing solution, the yarn is displaced in the direction opposite to the rotational direction of the roll. An additional roller engages with the driven roller displacing the yarn so as to form a squeezing pair therewith, and there is an additional tank having a scraper. The scraper is in permanent contact with the roll surface below the zone of feeding the yarn thereto and is adapted to remove the layer of finishing solution from the roll surface. The apparatus according to the invention enables the complete washing of yarn with a low consumption of finishing solution.

4 Claims, 9 Drawing Figures

APPARATUS FOR WASHING YARN DURING MOVEMENT THEREOF

The present invention relates to the manufacture of artificial yarn, and more particularly, to apparatus for washing freshly spun artificial yarn during its movement.

The invention may be successfully used in bleaching yarn, as well as in finishing fibrous materials of any type, fed in the form of a continuous band, with finishing solutions.

At present, in the continuous manufacture of artificial (viscose) yarn, the washing, that is the removal of components of a spinning solution, is effected with hot water fed to the yarn which is moved by means of pairs of rolls having their axes crossed in space, or by the method of complete immersion of the yarn into troughs containing a finishing solution with subsequent squeezing of the yarn between rolls.

All the above-described methods of washing freshly spun yarn are deficient in a high consumption of finishing solutions (water). For example, the consumption of water per one spinning end in machines with the pairs of rolls or with conjugated rollers is of 40 1/hr. which complicates the recovery of reactants removed from the yarn during its washing in the finishing solution. In addition, a high water consumption is associated with a large power consumption and cumbersome water circulation systems.

Known in the art is a method of washing a continuously moving material comprising the step of immersing the material being treated into a finishing solution with subsequent squeezing at a certain distance from the immersion zone, the immersion and squeezing steps being alternately repeated. This method is, however, inefficient since the material is treated in one and the same finishing solution in which the components being washed-off are continuously accumulated.

One of the important disadvantages of this method also consists in that the finishing process cannot be effected at high speeds of the material feeding (such as at 150 – 200 m/min) due to the splashing of the finishing solution in the service zone so that unfavourable conditions are created for operation of the staff.

Known in the art is also a method of washing freshly spun yarn on rotating rolls partially immersed in a finishing solution. The rotating roll entrains with its surface a small quantity of the finishing solution in the form of a boundary layer which is transferred to the yarn during the saturation when the yarn permanently or intermittently engages that portion of the roll surface which is located above the tank. Between the saturation zones, the yarn is spaced apart from the roll surface for diffusion. By this method, the consumption of finishing solution is considerably reduced as compared to the above-described method so that the content of the washed-off components in the finishing solution can be considerably increased, and their recovery becomes less expensive. For finishing the yarn, a number of rotating rolls are used, each being mounted in a separate tank to define separate treatment zones, and the yarn moves from one roll to another during the treatment. The efficiency of such a washing method is, however, low since the boundary diffusion layer of the solution which envelopes the yarn is transferred together therewith from one treatment zone into another so that each next zone is contaminated with solutions of components from the preceding zones.

Known in the art is an apparatus for application of a finishing solution to yarn by contacting the yarn with the surfaces of rotating rolls mounted in one and the same tank and partially immersed in a finishing solution contained therein. In this apparatus there are provided guide means for urging the yarn against the roll surface, and the linear speed of the roll is equal to speed of movement of the material being treated and has the same direction therewith. This apparatus cannot be employed to treat yarn moving at a high speed, such as at 150–200 m/min, due to the splashing of the solution. To eliminate this disadvantage, the roll must have such a large diameter that compact equipment can not be constructed.

The use of such a finishing method requires a high consumption of finishing solutions, whereby no effective recovery of these solutions is possible.

It is an object of the present invention to provide apparatus for washing freshly spun yarn during its movement, wherein the saturation of the yarn with a finishing solution is effected in such a manner as to considerably improve the efficiency of washing with low consumption of finishing solution, small size of the apparatus and at a speed of the yarn of 150–200 m/min.

In accordance with the above and other objects, washing freshly spun yarn takes place during the movement thereof while intermittently saturating the yarn with a finishing solution by repeatedly contacting it with the surface of a rotating roll extending outside a tank containing the finishing solution and carrying a layer of said solution, and spacing the yarn apart from the roll surface between the saturation zones so as to ensure the diffusion of solution therein, according to the invention. In order to ensure the intermittent saturation of the yarn with a finishing solution, the yarn is displaced in the direction opposite to the rotational direction of the roll, and during the spacing of the yarn apart from the roll surface, the yarn is squeezed, and the layer of finishing solution transferred by the roll surface is removed, after the repeated contact with the yarn, into another tank located in the zone disposed below the point of the yarn feeding for primary saturation with the finishing solution.

The displacement of the yarn in the direction opposite to the rotational direction of the roll rotation ensures a repeated contact of the yarn with the finishing solution, the yarn being saturated upon every contact with fresh portions of the solution fed in the opposite direction in the form of a layer on the roll surface. The squeezing of the yarn in the zones of its spacing apart from the roll surface permits to effect its washing more completely since the layer of finishing solution transferred by the roll is not contaminated with the waste solution. In addition, this enables the feeding of yarn at a speed of 150–200 m/min.

The removal of the layer of finishing solution from the roll surface into another tank eliminates the contamination of finishing solution in which the rotating roll is partially immersed. This permits to substantially reduce the quantity of finishing solution consumed for washing, to improve the efficiency of washing since the yarn is intermittently saturated with the fresh finishing solution.

The invention is characterized in that the squeezing of yarn is effected at a distance from the roll surface which is at least ten times greater than the length of a zone of contact of the yarn with the layer of finishing solution on the surface of the rotating roll. This contributes to the most complete washing of yarn since the squeezing occurs at the moment where the finishing solution has already diffused over the entire cross-section of the yarn while the components of a spinning bath have been partially dissolved in this solution.

The invention is characterized in that the yarn is displaced along a zigzag path above a portion of the roll surface which extends outside the finishing solution with at least two steps of spacing the yarn apart from the roll surface for squeezing and diffusion.

Such displacement of the yarn permits to increase the length of the portion of yarn moving above that part of the roll surface which extends outside the finishing solution, and to increase the number of portions in contact with the roll surface for saturation with the finishing solution. This contributes to the most complete washing of yarn. In addition, this feature provides for a possibility of increasing the speed of yarn movement up to 200 m/min and even higher without increasing the rotational speed of the roll, whereby the consumption of finishing solution may be reduced, and the splashing of finishing solution normally occuring at high roll speeds is eliminated so that the labour conditions are improved.

The apparatus according to the invention comprises a tank for a finishing solution, a rotating roll partially immersed in the finishing solution contained in the tank, and at least two guides mounted directly adjacent to that portion of said roll which extends outside the finishing solution, to effect the contact of yarn with a layer of finishing solution transferred by said roll, there being provided a driven roller disposed above the roll and between the guides in a spaced relation thereto for spacing the apart from the roll surface. According to the invention, the above-described apparatus is provided with an additional roller which is in permanent engagement with the driven roller so as to form a squeezing pair of rollers for squeezing the yarn, and an additional tank having a cantilevered scraper which is in permanent contact with the roll surface at a point below the zone of feeding the yarn thereto so as to remove the finishing solution from the roll surface.

This construction of an apparatus for washing yarn does not result in any increase in the size of a machine for producing artificial yarn, while enabling an improvement of its productivity and allowing the separation of the finishing solution which has contacted the yarn from the remaining solution in which the rotating roll is partially immersed. The separation of this solution enables the recovery of reactants therefrom with minimum expenses.

The invention is also characterized in that a plurality of squeezing pairs of rollers for squeezing the yarn are mounted above that part of the roll surface which extends outside the finishing solution, thereby contributing to almost complete washing of yarn without increasing the size of the apparatus and spinning machine as a whole.

The invention is also characterized in that the squeezing pairs of rollers for squeezing the yarn are mounted along an imaginary arc which extends concentrically with the surface of the rotating roll, or at both sides of said arc.

Therefore, the proposed apparatus for washing freshly spun artificial yarn according to the invention effects the washing of yarn to obtain specified characteristics thereof with a small consumption of finishing solution (1–3 l/hr) and at a speed of the yarn movement of 150–200 m/min and even higher, as well as to efficiently recover the finishing solution and to obtain pure waste water.

The invention will now be described with reference to a detailed description of an embodiment of the method and apparatus illustrated in the accompanying drawings, in which.

Figure 2:
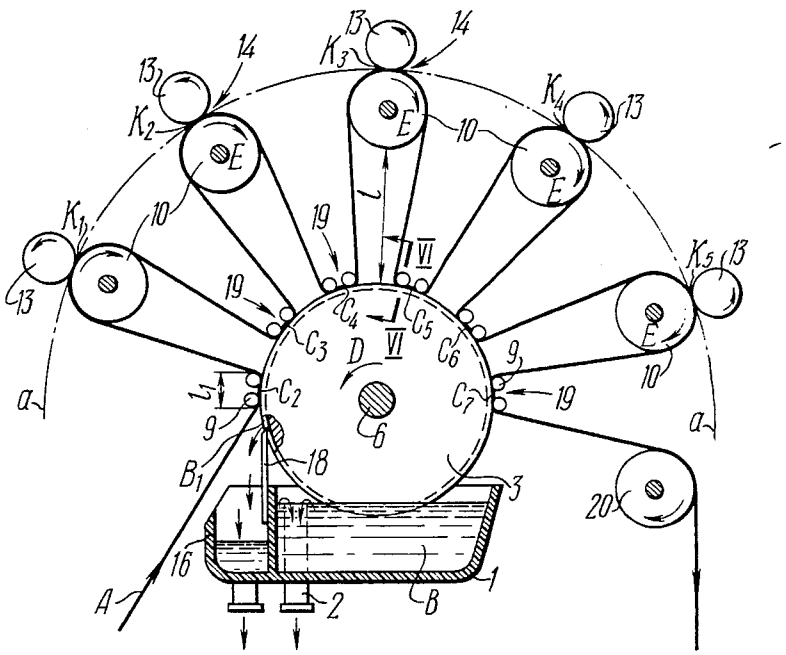
FIG. 2 is another embodiment of the apparatus.
Figure 1:
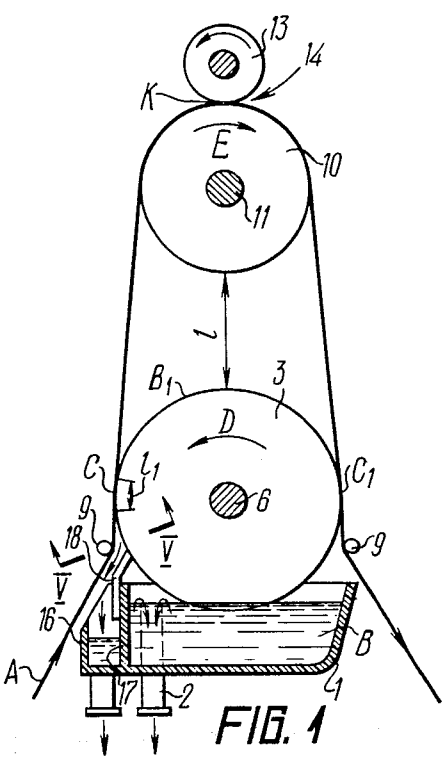
FIG. 1 shows a principle diagram of an apparatus for washing freshly spun artificial yarn according to the invention.
Figures 3, 4A, 4B, 4C:
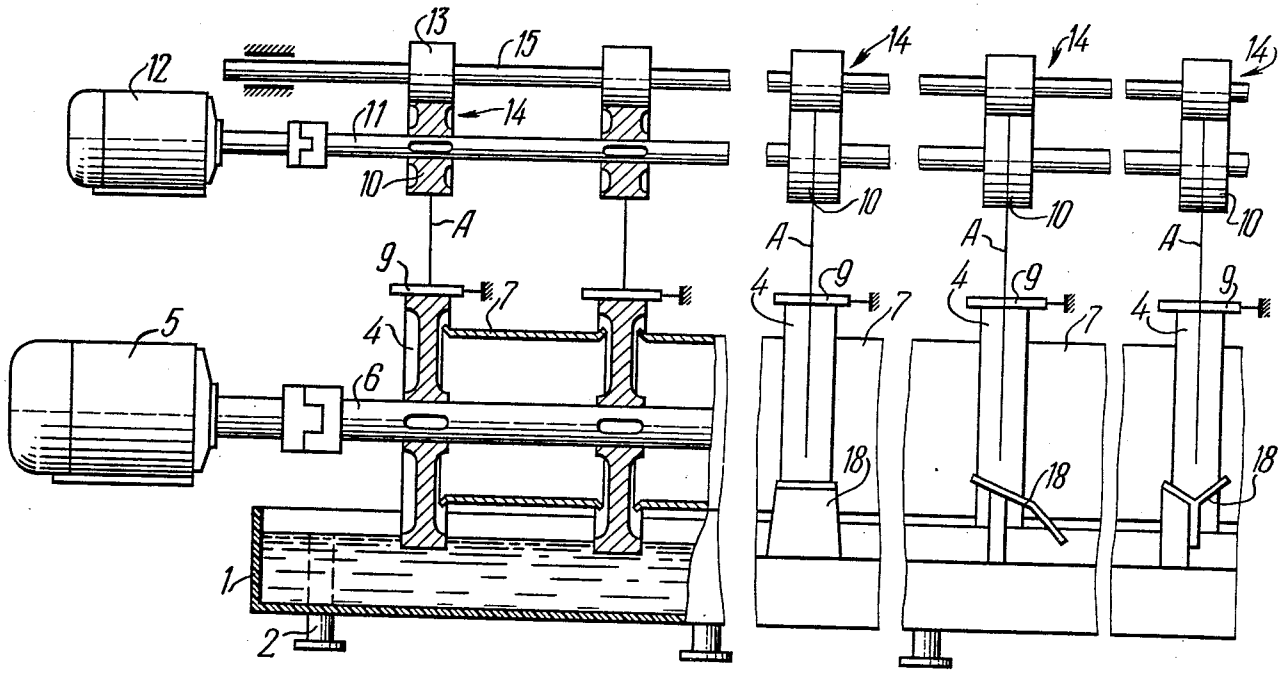
FIG. 3 shows a side elevation of the apparatus shown in FIG. 1, partially in section.
Figure 5:
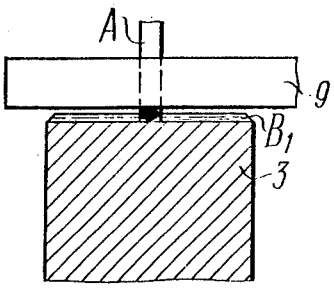
Figure 6:
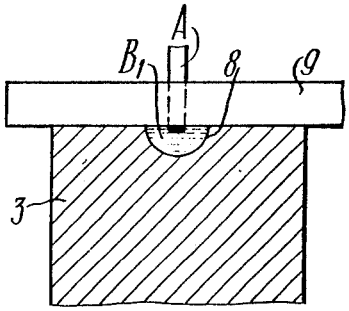
Figure 7:
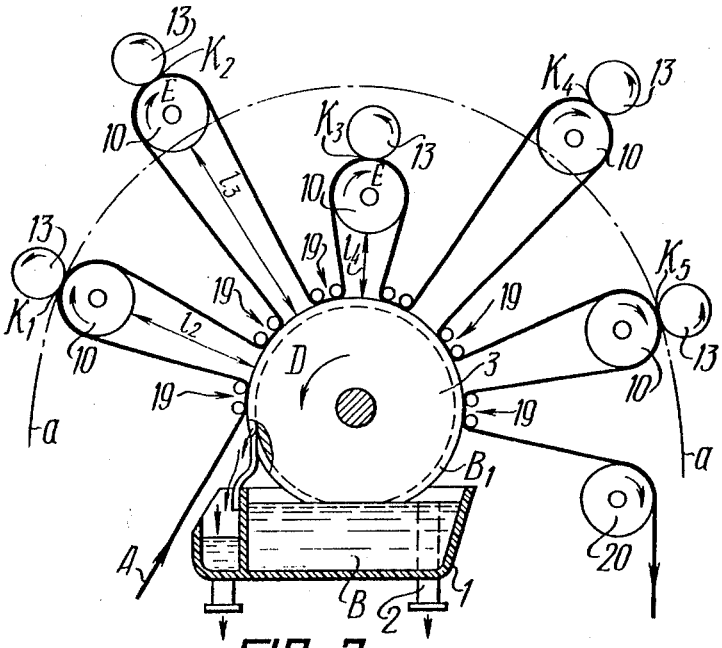

FIGS. 4*a*, 4*b*, 4*c* show various embodiments of the arrangement and location of a scraper;

FIG. 5 is a sectional view taken along the line V—V in FIG. 1;

FIG. 6 is a sectional view taken along the line VI—VI in FIG. 2;

FIG. 7 is an embodiment showing the location of squeezing pairs of rollers.

The washing of freshly spun artificial (viscose) yarn during its movement consists with the apparatus of the invention in that a yarn A (FIG. 1) is intermittently saturated with a finishing solution B (water) in successive zones C and $C_1$ of contact thereof with a layer $B_1$ of this solution which is transferred in the direction opposite to the yarn movement by the surface of a rotating roll partially immersed in the finishing solution B contained in a tank. Thus, the yarn A is saturated with the finishing solution B on that portion of the roll surface which extends outside the solution. During such movement of the yarn, the filament repeatedly contacts the layer $B_1$ of finishing solution which is then removed into another, additional tank so as prevent it from mixing with the fresh finishing solution B. Between the zones C and $C_1$ of saturation, the yarn A is spaced apart from the roll surface for diffusion and is subjected to squeezing. The squeezing is effected at a distance from the roll surface which is by at least ten times greater than the length of the zone of contact of yarn with the finishing solution.

In order to ensure the most complete washing of yarn, it is displaced above the portion of the roll surface which extends outside the finishing solution along a zigzag path (as shown in FIG. 2) with at least two steps of spacing apart from the roll surface for squeezing and diffusion.

The washing of yarn is preferably effected with five steps of spacing it apart from the roll surface.

The washing is carried out in an apparatus mounted in a conventional spinning machine between means for spinning and final regeneration of yarn and a mechanism for drying and winding (not shown).

The apparatus comprises a tank 1 (FIGS. 1 and 2) for the finishing solution B having a pipe 2 connected to a conduit for discharging excessive finishing solution from the tank 1, and a solution-transfer roll means formed by a rotating roll 3. The roll 3 is made of separate disks 4 (FIGS. 3 and 4) fixed to a shaft 6 driven by an electric motor 5. The direction of rotation of the disks 4 of roll 3, (FIGS. 1 and 2) is indicated by an arrow D. The number of the disks 4 (FIGS. 3 and 4) corresponds to the number of spinning ends of the machine. In order to avoid the contamination of the shaft 6, as well as to prevent yarn from being wound thereon, there are provided, between the disks 4, cylindrical shields 7 which rotate together therewith.

The peripheral surfaces of the disks 4 may be smooth as shown in FIG. 5, and then the solution B is uniformly distributed over this surface in the form of the layer $B_1$, or this peripheral surface may be provided with grooves 8 (FIG. 6) extending normally to the generatrix of the peripheral surface of the disk. The depth of the groove 8 depends on the quantity of the solution B required for washing the yarn or the yarn thickness. The entire layer $B_1$ of solution transferred by the surface of the disks 4 (FIG. 1) is concentrated in the groove 8.

Two stationary guide means 9 providing for a contact of the yarn A with the layer $B_1$ of finishing solution transferred by the surface of the roll 3 are mounted above that portion of the roll 3 which extends outside the solution B contained in the tank 1 directly adjacent to the surface of the roll or at a distance of twice the diameter of the yarn A. Each of said guides 9 (FIG. 3) is fixed to the machine frame and is adjustable during the adjustment of the machine. Structurally, the guides 9 may be fixed by any appropriate means.

A driven roller means 10 is mounted between the guides 9 (FIGS. 1 and 2) at a distance 1 from the surface of the roller 3. The roller 10 is adapted to displace the yarn A. The distance 1 between the roller 10 and the roll 3 is selected on the basis of the thickness of the yarn A, as well as depending on the length of the zones C of contact of the yarn with the layer $B_1$ of finishing solution so as to ensure the diffusion of finishing solution into the yarn and the diffusion of components of a spinning bath from the yarn into the solution. We have found that the diffusion can be completed when the distance 1 between the surfaces of the roller 10 and roll 3 is at least ten times greater than the length $l_1$ of the zones C of contact of the yarn A with the layer $B_1$ of finishing solution.

Since the roll 3 is composed of the disks 4, the rollers 10 are mounted at the distance 1 from each of the disks 4.

All the roller 10 (FIGS. 3 and 4) are fixed to a shaft 11 rotated by an electric motor 12 in the direction opposite to the rotational direction of the roll 3 as indicated by arrow E in the drawings. Thus motor 12 forms a means for rotating the drive roller means 10 while the motor 5 forms a means for rotating the solution-transfer roll means 3. As a result, the yarn A is displaced by the roller 10 in the direction opposite to the rotational direction of the roll 3, that is the yarn A moves to meet the layer $B_1$ of finishing solution which is transferred by the surface of the rotating roll. The employment of independent drives for rotating the rollers 10 and the roll 3 permits to select different speeds of rotation for the roll and rollers, respectively. Thus, the rotational speed of the rollers 10 is selected to be higher than the rotational speed of the roll. Accordingly, the yarn is moved by the rollers 10 at a greater speed than the relatively low speed of the roll 3. This facility permits to considerably reduce the consumption of the finishing solution B and to create favourable labour conditions in the zone of the apparatus.

Mounted adjacent to each roller 10 there is an additional roller means 13 which is in permanent engagement with the driven means 10 so as to form therewith a squeezing pair 14 of roller means for squeezing the yarn A. The rollers 13 are mounted on an axle 15 and are rotated by the rollers 10.

In order to prevent the mixing of the contaminated finishing solution squeezed from the yarn A by the squeezing pair 14 of rollers from mixing with the finishing solution B contained in the tank 1, this contaminated solution is to be removed. The removal of contaminated finishing solution from the surface of the pair 14 of rollers can be effected using any appropriate means, such as a scraper or a driven roller which is perforated or incorporates means for creating vacuum.

An additional tank 16 is located adjacent to the roll 3 (FIG. 1) on the side of feeding the filament A thereto. The additional tank 16 is separated from the tank 1 by means of a partition wall 17 and is provided with a discharge pipe connected to a conduit for discharging the waste finishing solution for recovery. The same conduit receives the contaminated finishing solution squeezed from the yarn A by the squeezing pair 14 of rollers. Mounted on the partition wall 17 are cantiflevered scrapers 18 whose number corresponds to the number of the disks 4 forming the roll 3.

Each scraper 18 has a free end thereof in permanent contact with the surface of a corresponding disk below the zone of feeding of the yarn A to the disk so as to remove the layer $B_1$ of finishing solution from the disk surface into the additional tank 16.

The scrapers 18 can be of various shapes, such as in the form of a plate mounted in parallel with the generatrix as shown in FIG. 4*a*, or in an inclined position relative thereto as shown in FIG. 4*b*, or they may comprise V-shaped members as shown in FIG. 4*c*.

In order to ensure the most complete washing of the filament A (FIG. 2) from impurities of the spinning bath, there is provided a plurality of guides 9 and squeezing pairs 14 of rollers as shown in FIG. 2 mounted above the portion of the roll 3, that is above each disk 4 extending outside the finishing solution contained in the tank 1. In order to improve the conditions for saturation of the yarn A with the finishing solution, the zone of contact C of the yarn A with the layer $B_1$ of finishing solution of the surface of each disk 4 is enlarged by employing pairs of guides 9 making up guide pairs 19, the length $l_1$ of the zone of contact C depending on the distance between the guides 9 of each pair 19. Between every two pairs 19 of guides 9 there is mounted a squeezing pair 14 spaced at a distance *l* from the disk surface. The squeezing paris 14 are mounted along an imaginary arc a—a extending concentrically with the surface of the disk 4, that is in an equally spaced relation to the geometric axis of the disk, or the squeezing pairs are mounted at both sides of this imaginary arc a—a as shown in FIG. 7, that is at least three different distances $l_2$, $l_3$, $l_4$ from the geometric axis of the disk. It should be noted, however, that the squeezing pairs 14 of rollers may be also mounted in line (not shown), and in that case different conditions for diffusion are provided similarly to the case shown in FIG. 7.

Freshly spun yarn is washed in the apparatus according to the invention as follows.

The yarn A (FIGS. 1 and 2) is fed to the rotating roll 3 on the side of location of the additional tank 16 and is directed under the guide 9 (FIG. 1) or under the pair 19 of guides 9 (FIG. 2). Then the yarn A is directed into a nip between the rollers 10 and 13 of the squeezing pair 14 and further under the next guide 9 (FIG. 1) or under the next pair 19 of guides 9 and so on. Thus, the yarn A is spaced apart from the portion of the roll surface in the zone $CC_1$ between two guides 9 (as shown in FIG. 1), or it extends above the roll 3 along a zigzag path (as shown in FIG. 2) thus having a plurality of zones $C_2$, $C_3$, $C_4$, $C_5$, $C_6$ and $C_7$ of contact with the surface thereof and a plurality of zones spaced apart from the roll surface which are located between the zones $C_2$ and $C_3$, $C_3$ and $C_4$, $C_4$ and $C_5$, $C_5$, and $C_6$, $C_6$ and $C_7$.

The yarn A, after having passed around the ultimate pair 19 of guides 9, is fed to a driven roller 20 feeding the yarn for a further treatment.

Then the electric motors 5 and 12 are simultaneously energized (FIG. 3) for rotating the shaft 6 with the roll 3, and hence, the disks 4, and the shaft 12 with the rollers 13, respectively.

The rotating disks 4 entrain with their surfaces a part of the finishing solution B from the tank 1 to transfer it in the form of the layer $B_1$ uniformly distibuted over the entire surface (as shown in FIG. 5) or filling the groove 8 (FIG. 6). The rollers 10 rotating in the direction indicated by arrow E (FIG. 2) rotate the rollers 13 to displace the yarn A in the direction opposite to the rotational direction of the roll 4 indicated by arrow D. Thus, the yarn A is saturated with the finishing solution in the zone C (FIG. 1) or $C_2$ (FIG. 2) of contact with the surface of the disk 4 and is subsequently spaced apart from its surface to pass in the nip of the pair 14 of rollers to be squeezed at a point K. During the squeezing, the contaminated solution is squeezed from the yarn A to be removed by any appropriate means into a conduit for recover. Therefore, the priate means into a conduit for recovery. Therefore, the concurrent diffusion of the finishing solution into the yarn and of components of the spinning bath from the yarn into the solution takes place in the zone CK (FIG. 1) or $C_2K_1$ (FIG. 2). After the squeezing, the yarn A is again directed to the roll surface for saturation with the finishing solution in the zone of contact $C_1$ (FIG. 1) or $C_3$ (FIG. 2). The successive saturation of the yarn with the finishing solution and squeezing thereof are repeated until the yarn has passed all the pairs 19 of guides 9 and all squeezing pairs 14 of rollers. Thus, as the yarn moves to effect alternating saturation and squeezing thereof, the content of components of the spinning bath in the yarn decreases. By the time the yarn a reaches the roller 20, it will contain substantially no components of the spinning bath. The entire process of washing the yarn along the path of its movement from the zone $C_2$ (FIG. 2) to the roller 20 is performed in one and the same layer $B_1$ of finishing solution which moves in the opposite direction relative to the yarn during the above-mentioned movement of the yarn while being transferred by the disk surface from the zone $C_7$ to the zone $C_2$. It should be noted that the substantially washed yarn is contacted in the zone $C_7$ with a fresh solution fed in the form of the layer $B_1$ from the tank 1, while the first contact of the yarn A leaving the spinning bath occurs in the zone $C_2$, wherein the yarn is saturated with the layer of finishing solution which has already contacted with the yarn in the zones $C_7$, $C_6$, $C_5$, $C_4$, $C_3$, that is the freshly spun yarn is initially saturated with the finishing solution which has been used for washing the yarn while at the ultimate stage of washing the yarn A contacts with the fresh finishing solution transferred with the surface of the disk 4 from the tank 1. This method of washing permits to substantially reduce the consumption of finishing solution for washing. Waste layer of finishing solution from the surface of the roll 3 is removed by means of the scraper means 18 into the additional tank 16 in the zone of feeding the yarn A to the roll.

The method according to the invention will now be illustrated by two examples given herebelow.

EXAMPLE 1

A solution of viscose containing 7.5% of $\alpha$-cellulose, 6.8% of alkali and having a ball viscosity of 50 sec and a maturity of 7 by Nacl was spun through spinnerets into a spinning bath containing 100 g/l of sulphuric acid, 90 g/l zinc sulphate and 200 g/l of sodium sulphate. The temperature of the spinning bath was 50°C. The spun yarn A (FIG. 1) containing 180 g/kg of sulphuric acid, 230 g/kg of zinc sulphate, 250 g/kg of sodium sulphate was fed for washing with a finishing solution (water) at 50°C. In the zone C the yarn was contacted with the layer $B_1$ of water transferred by the roll in an amount of 2–4 l/hr. In the zone CK, acids and salts contained in the yarn diffused into water. The length of the zone CK was 200 mm. At the point K the yarn was squeezed to remove 90% of sulphuric acid together with water. Upon repeating the process five times in the apparatus shown in FIGS. 2, 7, the yarn was completely washed and fed for further treatment.

EXAMPLE 2

The spinning of the yarn and washing thereof were conducted as described in Example 1, but the path of movement of the yarn from the zone of saturation to the squeezing zone, that is the length of the zone CK was equal to 400 mm. At the point K the yarn was squeezed to remove 95% of sulphuric acid together with water. Upon repeating the process four times, the yarn was completely washed.

What is claimed is:

1. An apparatus for washing freshly spun artificial yarn during its movement comprising: a tank for a finishing solution; a rotating solution-transfer roll means mounted over said tank and being partially immersed in said finishing solution contained in said tank so that a portion of the surface of said roll means extends outside the finishing solution for transferring said finishing solution out of said tank in the form of a layer at said roll surface; means for rotating said roll means; at least two yarn guide means mounted directly adjacent to that part of said roll means which extends outside said finishing solution for guiding yarn and effecting a contact of the yarn with said layer of finishing solution transferred by said roll means; a driven roller means mounted in spaced relation to said surface of said roll means and between said two guide means for receiving yarn from one of said guide means after the yarn is guided into contact with the finishing solution at said surface of said roll means by said one guide means and for directing the yarn after it travels partly around said driven roller means back to the other of said guide means to be guided by the latter again into contact with the finishing solution at said surface of said roll means while spacing the yarn apart from said surface of said roll means; means for rotating said driven roller means in a direction opposite to the rotational direction of said solution-transfer roll means; an additional roller means in permanent engagement with said driven roller means to form a squeezing pair of roller means defining a nip therebetween, the yarn being fed by said pair of roller means through said nip therebetween to travel in the direction opposite to the rotational direction of said solution-transfer roll means; an additional tank mounted below said solution-transfer roll means; a scraper means disposed in said additional tank in permanent contact with the surface of said rotating solution-transfer roll means below the zone of guiding of the yarn thereto by said one of said guide means, said scraper means removing said layer of finishing solution from said roll surface and directing the removed finishing solution into said additional tank.

2. An apparatus as claimed in claim 1 wherein a plurality of said squeezing pairs of roller means are mounted above and distributed circumferentially about that portion of said solution-transfer roll means surface which extends outside said finishing solution and wherein a plurality of pairs of said yarn guide means are respectively situated circumferentially between said plurality of squeezing pairs of roller means adjacent said surface of said solution-transfer roll means for guiding the yarn into contact with the layer of finishing solution as the yarn travels from one of said squeezing pairs of roller means to the next of said squeezing pairs of roller means.

3. An apparatus as claimed in claim 2, wherein said squeezing pairs of roller means are mounted along an imaginary arc which extends concentrically with the surface of said rotating roll.

4. An apparatus as claimed in claim 2, wherein said squeezing pairs of roller means are mounted at both sides of an imaginary arc extending concentrically with the surface of said rotating roll.

* * * * *